United States Patent [19]

Nakashima et al.

[11] Patent Number: 4,728,985

[45] Date of Patent: Mar. 1, 1988

[54] COPIER CAPABLE OF SETTING UP AN ERASE AREA ON A PHOTOCONDUCTIVE ELEMENT

[75] Inventors: Yoshihiro Nakashima, Tokyo; Shigeru Muramatsu, Yokohama, both of Japan

[73] Assignee: Ricoh Company, Ltd., Tokyo, Japan

[21] Appl. No.: 875,726

[22] Filed: Jun. 18, 1986

[30] Foreign Application Priority Data

Jun. 20, 1985 [JP] Japan ..... 60-134935
Jun. 20, 1985 [JP] Japan ..... 60-134936

[51] Int. Cl.[4] ..... G03G 15/04
[52] U.S. Cl. ..... 355/7; 355/14 R
[58] Field of Search ..... 355/7, 3 R, 14 R, 14 C, 355/3 SH, 14 SH

[56] References Cited

U.S. PATENT DOCUMENTS 4,582,417 4/1986 Yagasaki et al. ..... 355/7
4,641,951 2/1987 Takagi et al. ..... 355/7

FOREIGN PATENT DOCUMENTS 150859 9/1982 Japan ..... 355/7
186734 10/1983 Japan ..... 355/7
15948 1/1984 Japan ..... 355/7
107362 6/1984 Japan ..... 355/7

*Primary Examiner*—R. L. Moses
*Attorney, Agent, or Firm*—Oblon, Fisher, Spivak, McClelland & Maier

[57] ABSTRACT

A copier having eraser means for erasing needless ones of latent images which are electrostatically formed on a photoconductive element. A non-erase area is set up in consideration of a paper size, document size, trimming size and magnification. The non-erase size corresponds to a particular area where a paper size, a document size (with a magnification changed) and a trimming size (with a magnification changed) overlap each other. The non-erase area is displayed to facilitate confirmation by an operator. Latent images outside of the non-erase area are erased by the eraser means.

2 Claims, 18 Drawing Figures

COPIER CAPABLE OF SETTING UP AN ERASE AREA ON A PHOTOCONDUCTIVE ELEMENT

BACKGROUND OF THE INVENTION

The present invention relates to a copier capable of specifying a minimum necessary area of a photoconductive area to be erased in relation to a paper size, document size, trimming size and magnification, so that latent images within the specified area only may be erased to produce a quality copy.

In a copier, it has been customary to reproduce a document by an electrophotographic process which includes steps of charging, exposing, erasing, developing and transferring. During the erasing step, eraser means of the copier performs front end erasure, side erasure and rear end erasure so as to remove needless ones of electrostatic latent images which are formed on a photoconductive element. A typical implementation for erasure control known in the art is optically erasing needless latent images on a photoconductive element based on the size of papers which is sensed by a paper size sensor, which is associated with a paper cassette. Another known implementation relies on a sensor sensitive to the size of a document.

The problem with any of such prior art erasure control schemes is as follows. Assuming that the erasure control is performed on, for example, a paper size basis, where the document size is smaller than the paper size, stains in those portions of a document feed belt, document pressing plate and others which are located outside of the document area are formed as images and transferred onto papers to degrade the reproduction. Meanwhile, where the document size is smaller than the paper size, even needless regions of the photoconductive element which will not be transferred to papers are developed by toner, aggravating toner consumption as well as the loads on a cleaning unit.

SUMMARY OF THE INVENTION

It is therefore an object of the present invention to provide a copier capable of setting up a minimum necessary area of a photoconductive document to be erased (hereinafter referred to as an erase area for convenience), thereby producing quality copies without imposing excessive loads on a cleaning unit.

It is another object of the present invention to provide a generally improved copier capable of setting up an erase area on a photoconductive element.

A copier of the present invention has a function of setting up a non-erase area on a photoconductive element responsive to a size of papers, a size of documents, a trimming size and a magnification and erasing latent images outside of the non-erase area, a direction in which the papers are fed being assumed to be a direction x and a direction perpendicular thereto a direction y. The copier comprises a paper size sensor for sensing a paper size (Ox, Oy) representative of a size of the papers, a document size sensor for sensing a document size (Ox, Oy) representative of a size of the documents, a trimming area sensor for sensing a trimming area size (Tx, Ty) representative of an area size after trimming, a magnification sensor for sensing a magnification R selected, and an eraser for erasing needless electrostatic latent images formed on the photoconductive element. An overlapping length of the Px, Ox×R and Tx×R selected is determined to be a length of the non-erase area in the direction x, and an overlapping length of the Py, Oy×R and Ty×R a length of the non-erase area in the direction y, whereby the eraser erases the latent images outside of the non-erase area.

The above and other objects, features and advantages of the present invention will become more apparent from the following detailed description taken with the accompanying drawings.

DESCRIPTION OF THE PREFERRED EMBODIMENT

While the copier capable of setting up an erase area on a photoconductive element of the present invention is susceptible of numerous physical embodiments, depending upon the environment and requirements of use, a substantial number of the herein shown and described embodiment have been made, tested and used, and all have performed in an eminently satisfactory manner.

Figure 1:
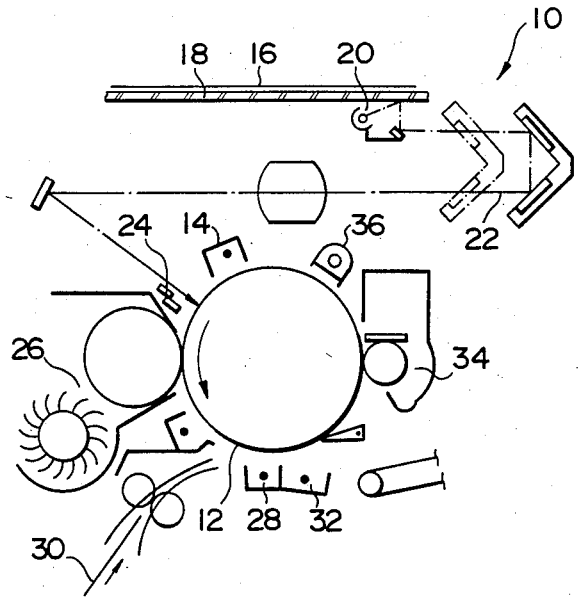
FIG. 1 is a schematic side elevation of a copier to which the present invention is applicable.
Figure 2:
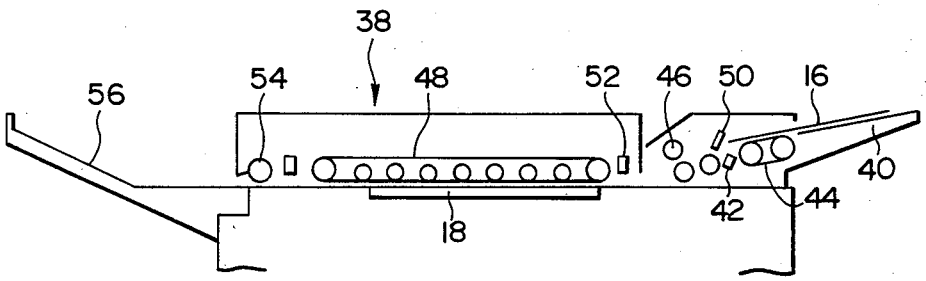
FIG. 2 is a schematic side elevation of an automatic document feeder (ADF)

Referring to FIG. 1 of the drawings, an electrophotographic copier to which the present invention is applicable is shown and generally designated by the reference numeral 10. The copier 10 includes a photoconductive element 12 which is in a form of a drum and rotatable as indicated by an arrow in the drawing. The drum is uniformly charged by a charger 14 to a predetermined polarity. Images on a document 16 which is laid on a glass platen 18 are illuminated by an illuminating unit 20 so as to be focused onto the drum 12 through optics 22, which includes mirrors and lenses. As a result, latent images representative of the document images are formed electrostatically on the drum 12. An eraser 24 which serves as erasing means erases the front and rear ends and opposite sides of the drum 12 where no latent images are formed. Then, the latent images are developed by a developing unit 26 and then transferred onto a paper 30 by a transfer charger 28. The paper 30 carrying the images therewith is separated from the drum 12 by a separating charger 32, then fixed at a fixing station, and then driven out of the copier. Meanwhile, the drum 12 is cleaned by a cleaning unit 34 and then irradiated by a discharging lamp 36 to erase residual latent images, the drum 12 thus regaining initial conditions thereof.

As shown in FIG. 18, an automatic document feeder (ADF) 38 is situated above the glass platen 18 so as to automatically feed the document 16. Being of a type well known in the art, the ADF 38 includes a switch 42 which becomes turned on by sensing the document 16 which may be laid on a document table 40. This sets up a standby state in an ADF copy mode. Upon generation of a paper feed signal, a separator belt 44, pull-out rollers 46 and a conveyor belt 48 are driven each in a rotational motion. The document 16 which is fed by the belt 44 is separated from another or other documents by a separator blade 50 and then fed by the rollers 46 and belt 48 to a predetermined position on the glass platen 18. During such paper feed, a size of the document 16 is sensed by document size sensor means 52. Upon completion of a copying cycle, the document 16 is discharged from the glass platen 18 toward a tray 56 by the belt 48 and discharge rollers 54.

Figure 3:
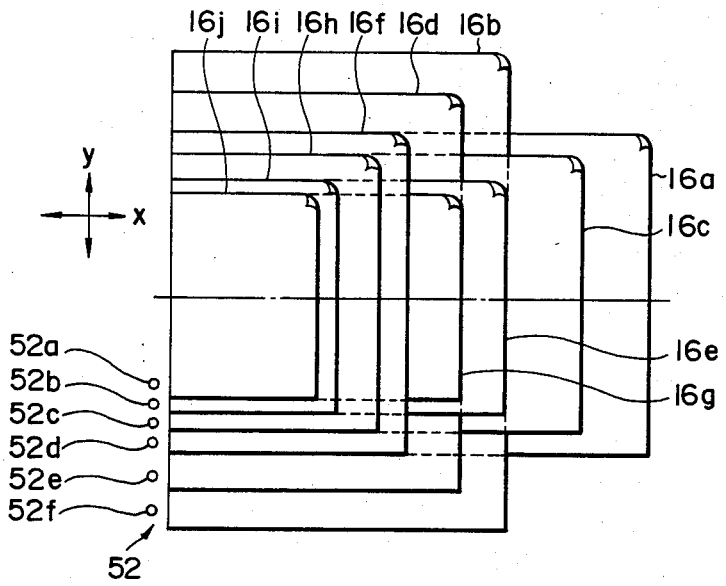
FIG. 3 is a view demonstrating a method of sensing a document size.
Figure 4:
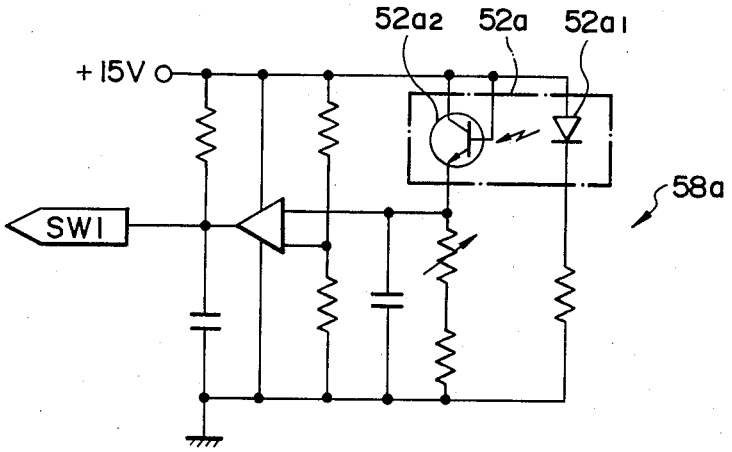
FIG. 4 is a circuit diagram showing means for sensing a document size.
Figure 5:
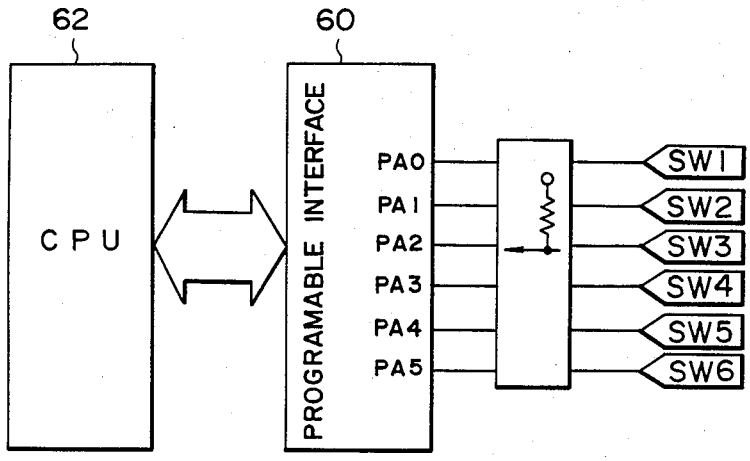
FIG. 5 is a block diagram associated with the means of FIG. 4.

The construction and operation of the sensor means 52 will be described with reference made to FIGS. 3 and 4. In the following description, a direction in which the paper 30 is fed (document scanning direction) is referred to as a direction x and a direction perpendicular thereto as a direction y, suffixes x and y being used hereinafter in that sense. In this particular embodiment, there are assumed ten different kinds of documents (center references): a horizontally long A3 (format) document **16*a*, a vertically long A3 document 16*b*, a horizontally long B4 document 16*c*, a vertically long B4 document 16*d*, a horizontally long A4 document 16*e*, a vertically long A4 document 16*f*, a horizontally long B5 document 16*g*, a vertically long B5 document 16*h*, a horizontally long A5 document 16*i*, and a vertically long A5 document 16*j*. An array of six photosensors 52*a* to 52*f* are arranged in the direction y in a document feed path in correspondence with such document sizes, or formats. As shown in detail in FIG. 4, the photosensor 52*a*, for example, comprises a light emitting element (LED) $52a_1$ and a light receiving element (phototransistor) $52a_2$. As the document 16 optically isolate the elements $52a_1$ and $52a_2$ from each other, the element $52a_2$ is turned on so that a sensor circuit 58*a* generates a sense output $SW_1$. However, so long as the optical path between the elements $52a_1$ and $52a_2$ is not disturbed by the document 16, the element $52a_2$ is not turned on causing the circuit 58*a* to deliver no sense output $SW_1$. All the other photosensors 52*b* to 52*b*, like the photosensor 52*a*, are implemented with a light emitting element and a light receiving element and produce, respectively, sense outputs SW2 to SW6 depending upon the presence/absence of the document 16**.

In the above construction, while the document 16 moves past the document size sensor means 52, it is possible to decide a length (width) Oy of the document 16 along the direction y by determining which one of the photosensors **52*a* to 52*f* has been turned on. It is also possible to determine a length Ox of the document 16** along the direction x by measuring the duration of the turnon of the particular photosensor.

In this manner, a particular document size (Ox, Oy) and, therefore, which one of the documents **16*a* to 16*j* has been fed is determined. For the decision of a document size (Ox, Oy), outputs SW1 to SW6 of the respective sensor circuits are applied to a central processing unit (CPU) 62 via a programable interface 60. A port A (PA) of the interface 60** is used as an input mode. While only six photosensors are used in this embodiment, such is only illustrative and, alternatively, a number of photosensors may be arranged at the pitches of, for example, 5 millimeters in order to randomly sense irregular document sizes as well as regular ones. Further, in the case of an ordinary document pressing plate system, as opposite to the ADF system, document size sensors may be mounted on a document pressing plate.

Figure 6:
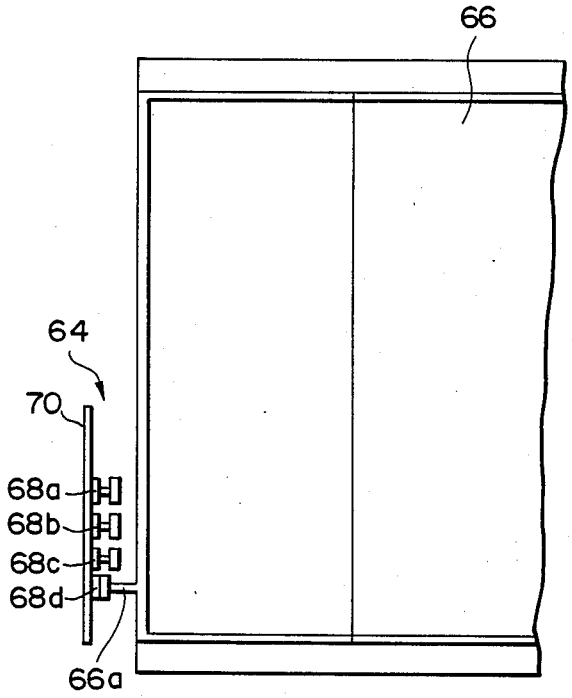
FIG. 6 is a view demonstrating a method of sensing a paper size.

Referring to FIG. 6, a specific construction of paper size sensor means 64 which is responsive to a size (Px, Py) of the paper 30 is shown. As shown, the sensor means 64 includes a plurality of switches **68*a* to 68*d* which are mounted on a PC plate 70. A particular one of the switches 68*a* to 68*d* is turned on by a lug 66*a* which protrudes from a paper cassette 66 to show a particular size of the papers 30, which are loaded in the cassette 66. Specifically, binary states (logical "L" and "H" levels) of the switchs 68*a* to 68*d*** are representative of various paper sizes as shown in Table below.

Paper Size Decision Table

| Paper Size | SW31a | SW31b | SW31c | SW31d |
|---|---|---|---|---|
| A3 Vertical | L | L | L | H |
| A3 Horizontal | L | L | H | L |
| B4 Vertical | L | L | H | H |
| B4 Horizontal | L | H | L | L |
| A4 Vertical | L | H | L | H |
| A4 Horizontal | L | H | H | L |
| B5 Vertical | L | H | H | H |
| B5 Horizontal | H | L | L | L |
| A5 Vertical | H | L | L | H |

Figure 7:
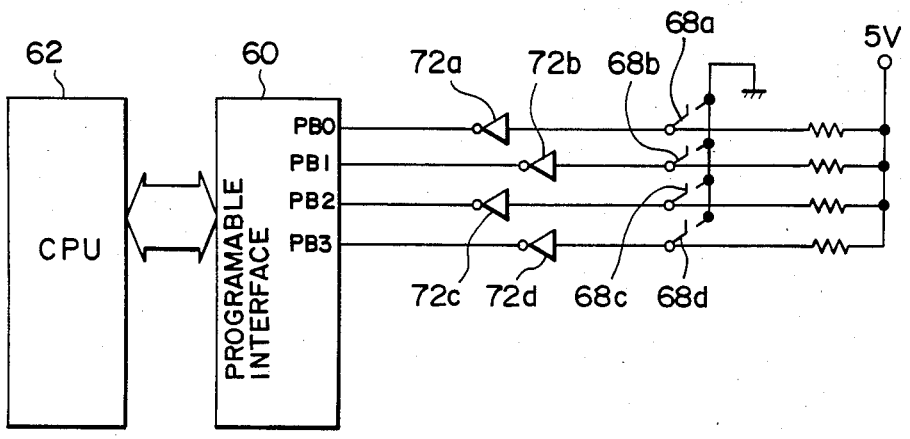
FIG. 7 is a circuit diagram representative of means for sensing a paper size.

As shown in FIG. 7, the switches **68*a* to 68*d* are respectively connected to inverters 72*a* to 72*d* which are in turn connected to ports B (PB) of the programable interface 60. The interface 60 is connected to the CPU 62, as previously stated. Assuming that the switch 68*d* is depressed by the lug 66*a* as shown in FIG. 6, the input levels from the switches 68*a* to 68*d* to their associated inverters 72*a* to 72*d* are "H", "H", "H" and "L", respectively. These logical levels are turned by the inverters 72*a* to 72*d* into "L", "L", "L" and "H" which are then applied to the CPU 62 via the interface 60. The CPU 62, therefore, determines that the paper 30** has the horizontally long A3 size. The dimensions Px and Py are naturally derived from the size determined so.

Figure 8:
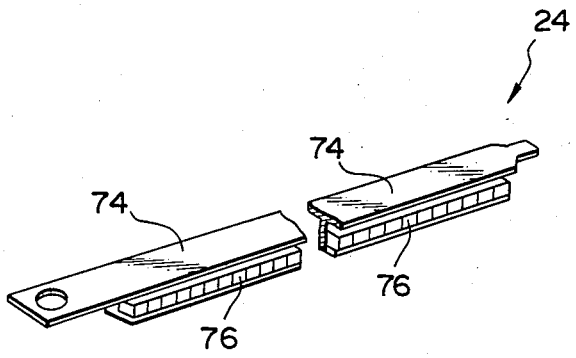
FIG. 8 is an external perspective view of an eraser.
Figure 9:
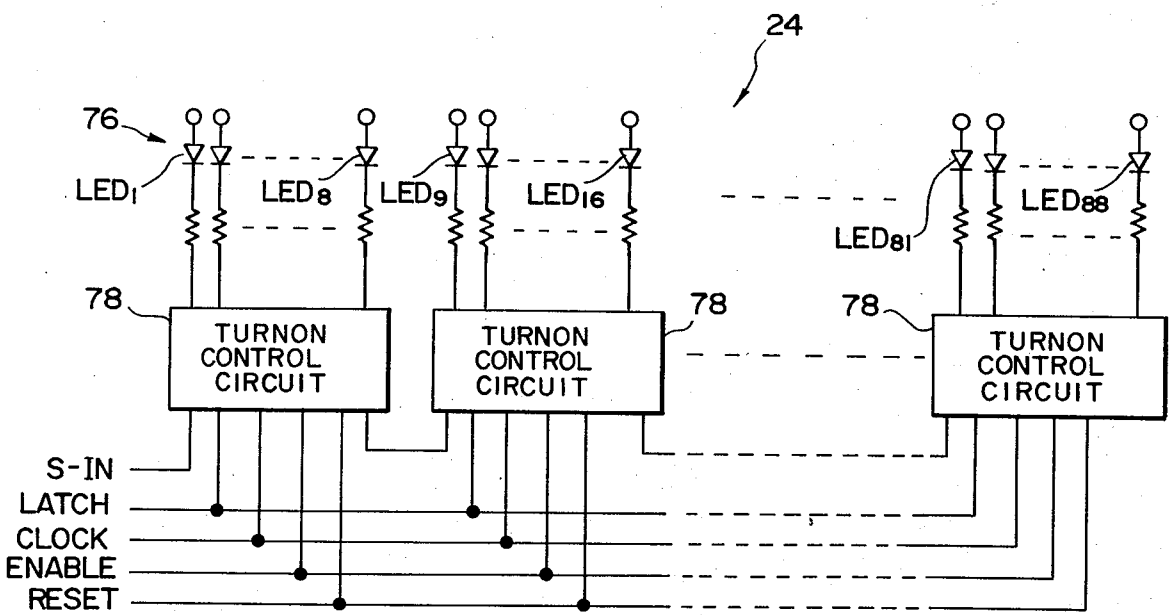
FIG. 9 is a diagram showing an electric circuit associated with the eraser.

Referring to FIG. 8, the eraser 24 comprises a number of LEDs 76 which are arranged in an array on a PC base 74 and over the entire length of the drum 12. The eraser 24 may be located before or after the exposing station as desired insofar as the location is between the charging station and the developing station. In a specific construction, eighty-eight LEDs 76 $LED_1$ to $LED_{88}$ may be arranged at the pitches of 5 millimeters. As shown in FIG. 9, the LEDs $LED_1$ to $LED_{88}$ are connected by eights to eleven turnon control circuits 78 each of which is implemented with an integrated circuit. In this construction, the LEDs $LED_1$ to $LED_{88}$ are individually turned on and off by their associated turnon control circuits 78 responsive to a serial data input S-IN, LATCH signal, CLOCK signal, ENABLE signal, and RESET signal.

Figure 10:
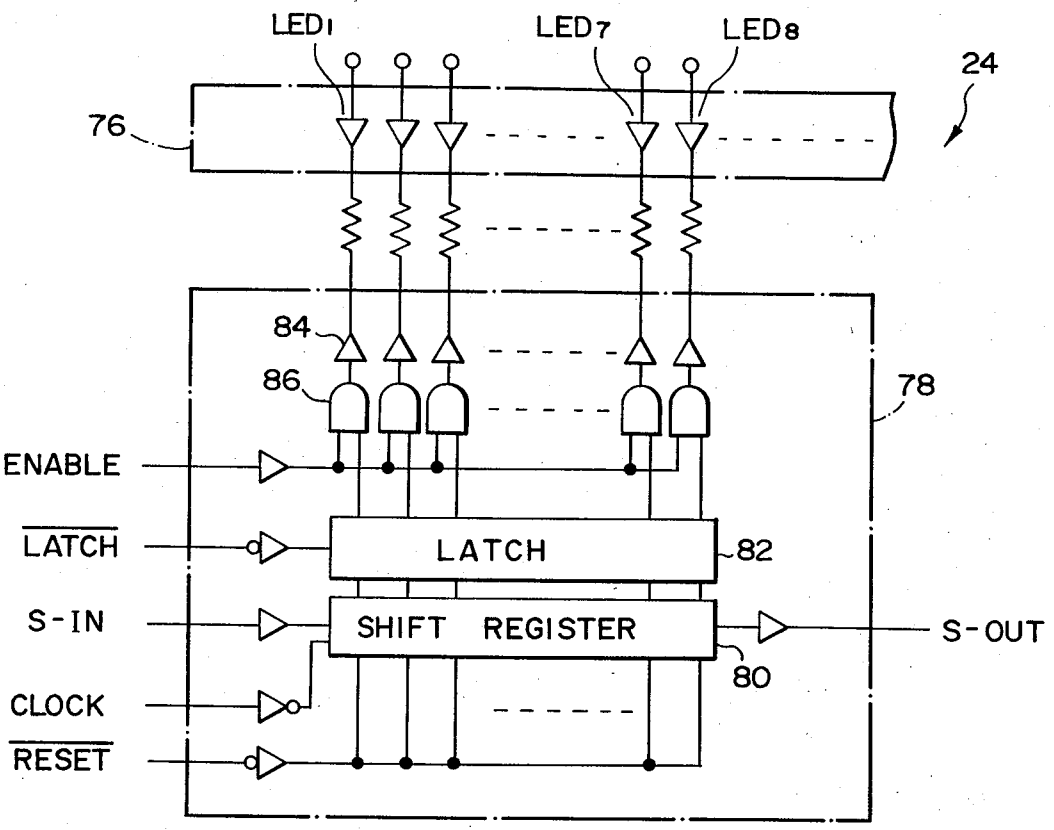
FIG. 10 is a diagram showing a part of the eraser.

Referring to FIG. 10, a specific construction of each of the turnon control circuits 78 is shown. The circuit 78 comprises an integral arrangement of a shift register 80 having a D-type flip-flop configuration, a latch 82, and drivers 84. The CLOCK signal and serial data S-IN are applied to the shift register 80 while a $\overline{\text{LATCH}}$ signal is applied to the latch 82. Further, the ENABLE signal is selectively applied to the drivers 84 via AND gates 86.

Figure 11:
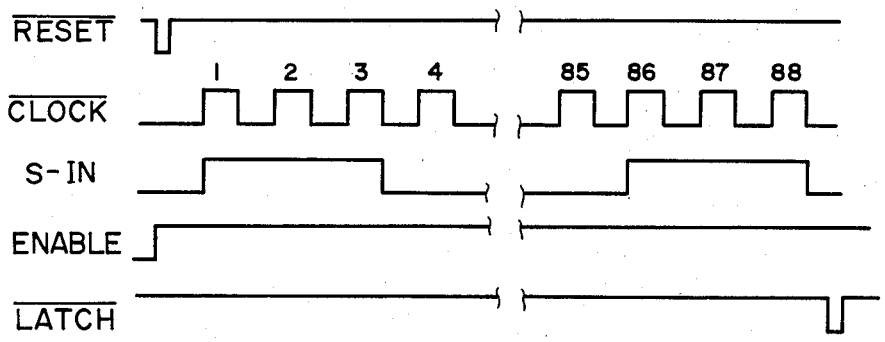
FIGS. 11 and 12 are timing charts.
Figure 12:
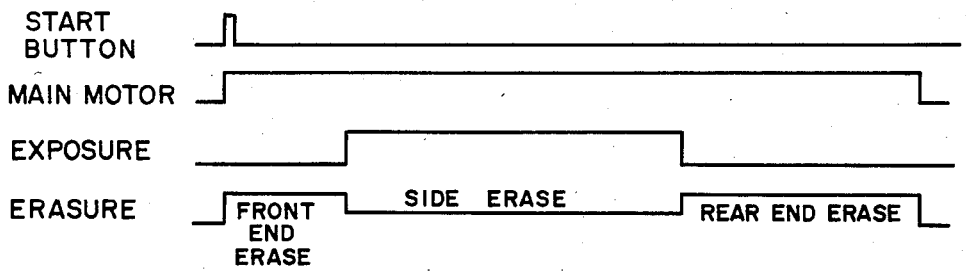

FIG. 11 shows an exemplary timing of delivery of control signals to the eraser 24. Because eighty-eight LEDs 76 are used in this particular embodiment, it suffices to sequentially deliver eighty-eight serial data S-IN signals in synchronism with the CLOCK signal. After the delivery of the eighty-eight data, the $\overline{\text{LATCH}}$ signal is made "L" level to latch those data in the latch 82 and, then, necessary ones of the drivers 84 are driven to turn on their associated LEDs 76 for erasure. Those LEDs 76 which are not supplied with turnon data are kept turned off. Until the $\overline{\text{LATCH}}$ signal becomes "L" level again, the LEDs 76 are turned on and off according to the data which have been entered at the previous "L" level of the $\overline{\text{LATCH}}$ signal. As schematically shown in FIG. 12, the operation of the eraser 24 is such that after the start of a copying cycle all the LEDs 76 are turned on to effect front end erasure, then in an image carrying area only the necessary LEDs 76 are turned on to effect side erasure, and then all the LEDs 76 are turned on again to effect rear end erasure.

Figure 13:
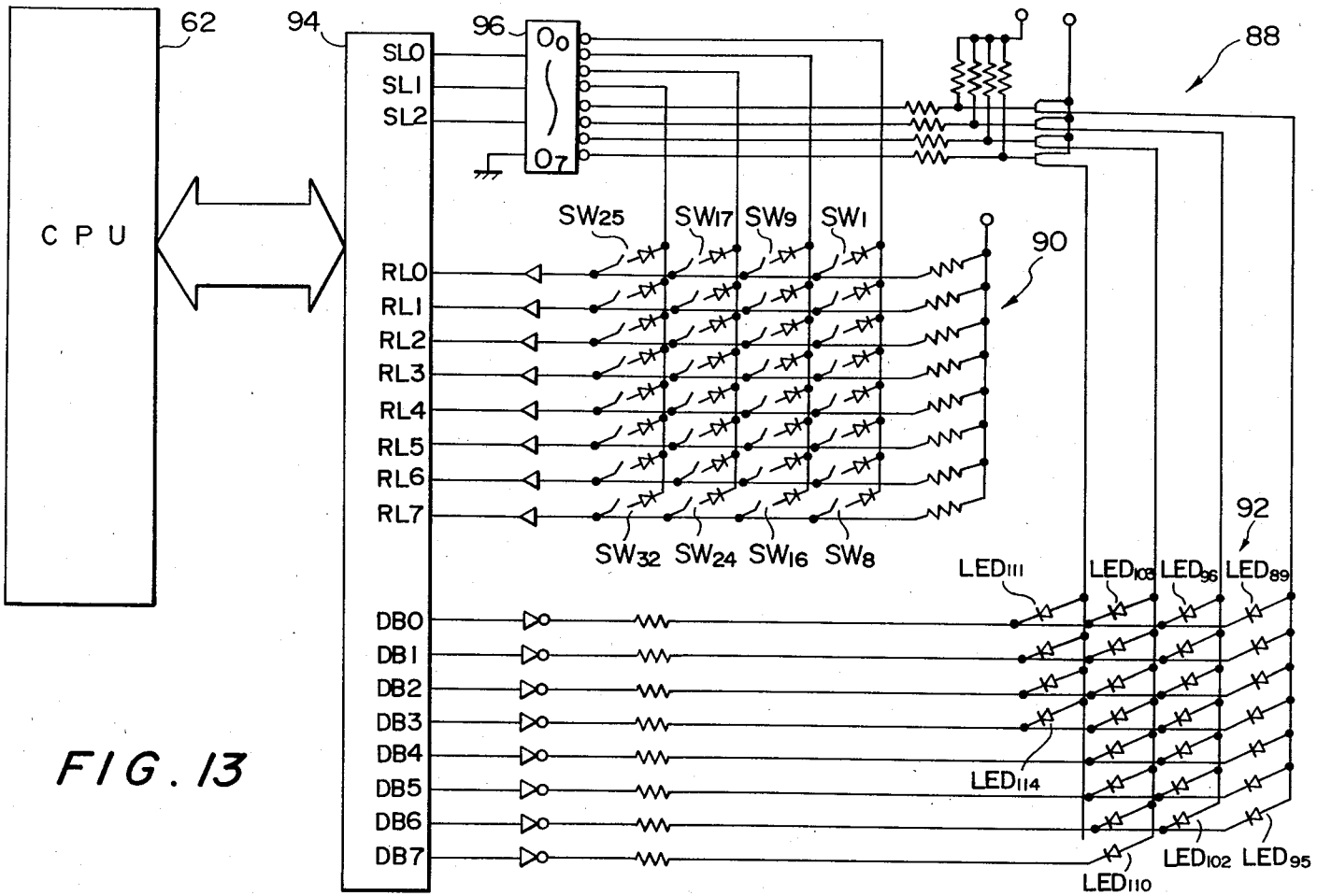
FIG. 13 is a circuit diagram representative of a control panel.

Referring to FIG. 13, a control panel 88 which is mounted on the copier 10 is shown. As shown, the control panel 88 comprises a keyboard section 90 and an LED display section 92 associated with the section 90. The control panel 88 is connected to the CPU 62 via a programable keyboard interface 94. The keyboard section 90 may be made up of thirty-two key switches $SW_1$–$SW_{32}$ as illustrated. Major ones of the key switches are ten key switches $SW_1$ to $SW_{10}$, a print key switch $SW_{15}$, a magnification key switch $SW_{20}$, a zoom magnification-up key switch $SW_{21}$, a zoom magnification-down key switch $SW_{22}$, an equal magnification key switch $SW_{23}$, a document key switch $SW_{30}$, and a trimming key switch $SW_{31}$. By programing the keyboard interface 94 by means of the CPU 62, it is possible to control the timing of scanning ports SL0 to SL2 of the interface 94. As output signals $O_0$ to $O_3$ of a decoder 96 are scanned by signals appearing at the ports SL0 to SL2, the key switches $SW_1$ to $SW_8$, $SW_9$ to $SW_{16}$, $SW_{17}$ to $SW_{24}$ and $SW_{25}$ to $SW_{32}$ are scanned to read the on/off states of the switches.

The LED display section 92, on the other hand, may comprise twenty-six LEDs $LED_{89}$ to $LED_{114}$ as illustrated. Among those LEDs, the $LED_{100}$ is adapted for magnification display, the $LED_{101}$ for zoom display, the $LED_{108}$ for trimming display, the $LED_{110}$ for print green display, and the $LED_{111}$ for print red display. The LEDs $D_{89}$ to $LED_{114}$, too, are checked for their on/off states by scanning output signals $O_4$ to $O_7$ of the decoder 96.

Figure 14A:
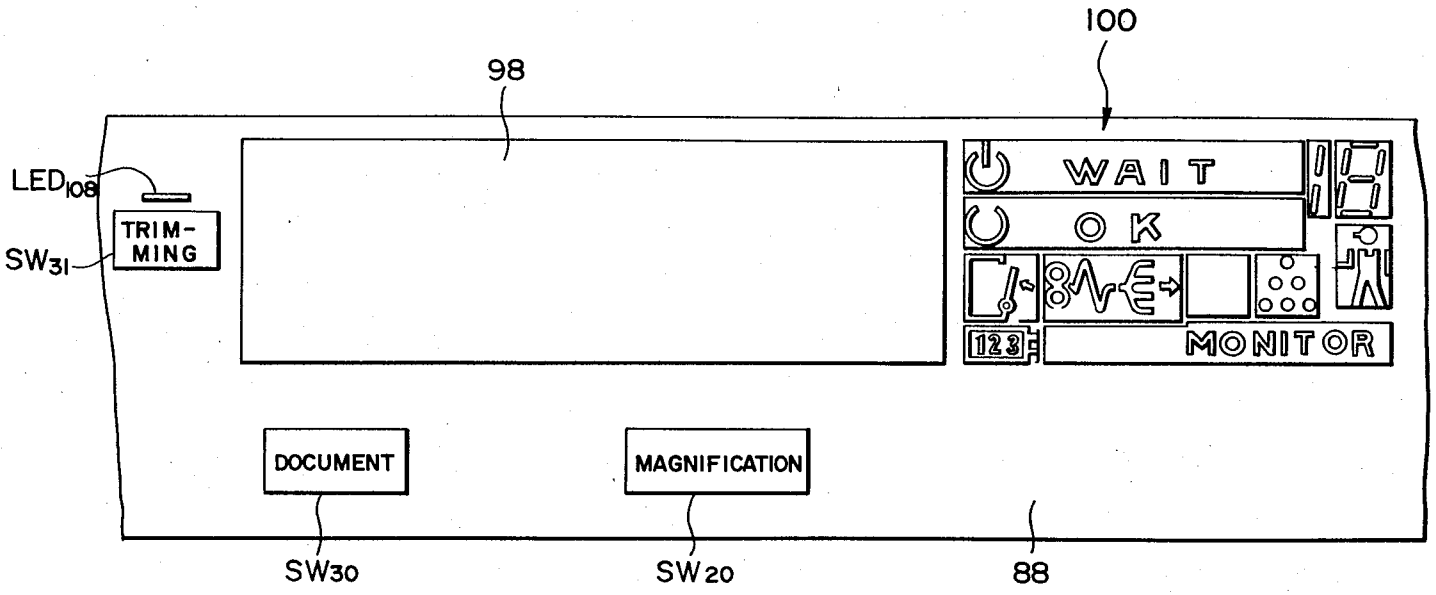
FIGS. 14A, 14B, and 14C are plan views each showing the control panel.

The control panel section 88 includes a display area, as shown in FIG. 14A. The display area consists of a liquid crystal display 98 which serves as 64×256 dots full-dot type display means, and a pictorial display 100 which is implemented with liquid crystal. While full-dot type liquid crystal for the display 98 is generally of a reflection type, in this particular embodiment liquid crystal of a transmission type is used to allow information being displayed to be seen more easily and is illuminated from behind by a back light. Although the back light may be implemented with any one of miniature bulbs, fluorescent lamps, cold cathode tubes, FL tubes and others, use is made of cold cathode tubes in this particular embodiment partly because liquid crystal is temperature dependent and partly because a large amount of light is available with such tubes. Because radiations from cold cathode tubes are white, the pictorial display 100 is provided with color filters to display information in red, blue and yellow in predetermined portions thereof.

Figure 14B:
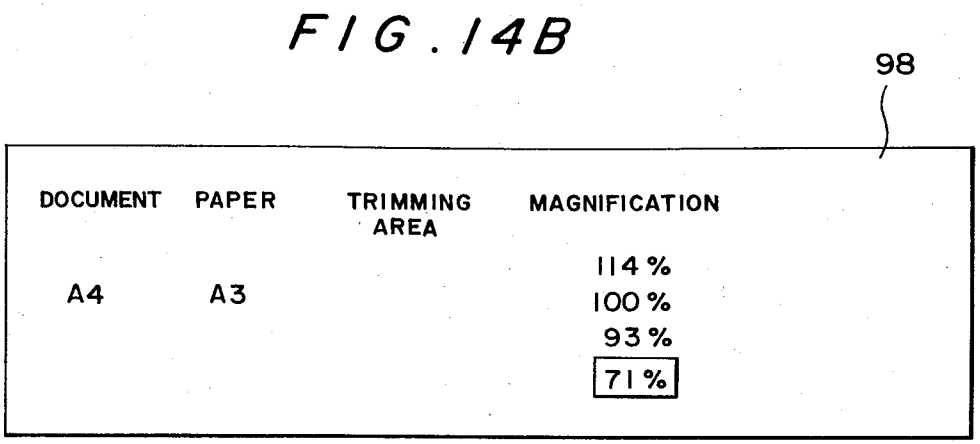

The copier in accordance with the illustrative embodiment has a variable magnification function. A reference will be made to FIG. 14B for describing an operation for selecting a magnification. First, the display 98 displays magnifications R which are 114% (enlargement), 100% (equal magnification), 93% (reduction), and 71% (reduction). A particular one of such four magnifications which is enclosed by a rectangle has been selected; in FIG. 14B, the magnification of 71% has been selected. In this condition, one may depress the magnification key $SW_{20}$ to select 114% and may depress it again to select 100%. In parallel with such manipulation, he or she may operate the zoom magnification-up key $SW_{21}$, zoom magnification-down key $SW_{22}$ and others to set up a desired magnification R more minutely.

Further, in this particular embodiment, the copier has a function of trimming document images, i.e., a capability of copying only a desired part of a document. To trim a document, one depresses the trimming key $SW_{31}$ on the control panel 88 to set up a trimming mode (the $LED_{108}$ adapted for trimming display is turned on), and specifies a desired part of the document 16 laid on the glass platen 18 by entering x and y coordinates through the ten keys $SW_1$ to $SW_{10}$. This allows a particular area size (Tx, Ty) after trimming, or post-trimming size, to be detected.

The erase control in accordance with this particular embodiment will be described in relation to the above-described construction. In this embodiment, an optimum erase area is set up in consideration of various kinds of information such as a user-specified post-trimming size (Tx, Ty) ((Tx×R, Ty×R) in the case of a magnification other than the equal one), document size (Ox, Oy) ((Ox×R, Oy×R) in the case of a magnification other than the equal one), and paper size (Px, Py). Dimensional relationships between those sizes are shown in FIGS. 15A and 15B, in which a hatched area represents a non-erase area which is not to be erased by the eraser 24.

Figure 15A:
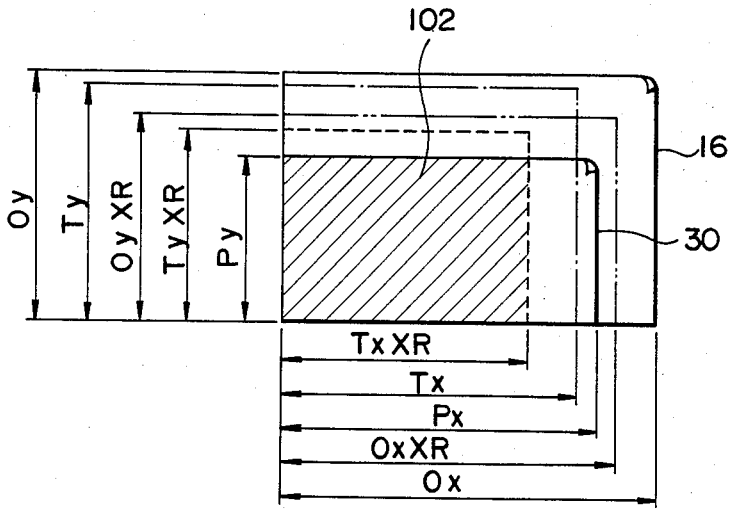
FIGS. 15A and 15B are plan views representative of dimensional factors essential for specifying a non-erase area, as opposed to an erase area.

Specifically, in FIG. 15A which demonstrates a case wherein a magnification other than the equal one is selected, an overlapping length of a length Px of the paper 30 in the direction x, a length Ox×R in the direction x after a change of magnification and based on a length Ox of the document 16 and a length Tx×R in the direction x after a change of magnification and based on Tx of a trimming size, i.e., a minimum lenth Tx×R is determined to be the length of the non-erase area 102 in the direction x. Likewise, an overlapping length of a length Py of the paper 30 in the direction y, a length Oy×R in the direction y after a change of magnification and based on a length Oy of the document 16 and a length Ty×R after a change of magnification and based on Ty of a trimming size, i.e., a minimum length Py is determined to be the length of the non-erase area 102 in the direction y. After the non-erase area 102 has been set up, the eraser 24 is so controlled as to erase an area of the drum 12 other than the non-erase area 102.

Figure 15B:
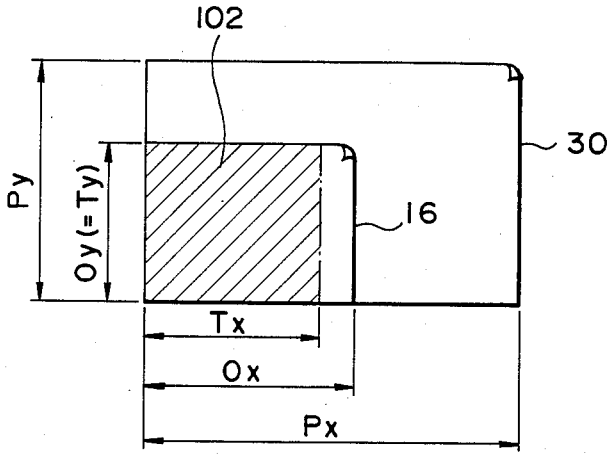

In the case of an equal magnification, the non-erase area 102 is set up as shown in FIG. 15B. Specifically, an overlapping length of Px, Ox and Tx, i.e., a minimum length Tx is determined to be the length of the area 102 in the x direction, and an overlapping length of Py, Oy and Ty (=Oy), i.e., a length Oy is determined to be a length of the area 102 in the direction y. Concerning a usual copying operation wherein a trimming is not commanded, the post-trimming size (Tx, Ty) may be regarded as being identical with the document size and, therefore, the non-erase area 102 is set up taking account of paper size (Px, Py) data, document size (Ox, Oy) data, and magnification R data. That is, an overlapping length of Px and Ox×R is determined to be the length in the direction x, and that of Py and Oy×R the length in the direction y.

Erasing latent images outside of the non-erase area 102 which is set up as discussed above eliminates the drawbacks particular to the prior art schemes. Specifically, even if a document size with trimming, magnification and others taken into account is greater than a paper size, toner images formed on the drum 12 are confined in the limited dimensions of the paper 30 so that wasteful toner consumption and excessive loads on the cleaning unit 34 are eliminated. Further, even if the document size mentioned above is smaller than the paper size, smears on the belt 48 and document pressing plate are prevented from being reproduced on the paper 30 because image regions other than a necessary one are erased.

Figure 14C:
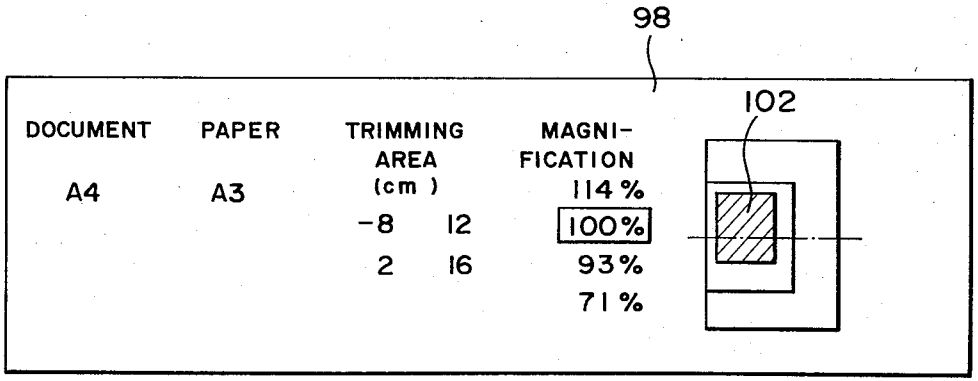

While the non-erase area 102 is defined as described hereinabove, in this particular embodiment the configuration of the non-erase area 102 is displayed by the display 98 to facilitate confirmation, as shown in FIG. 14C by way of example. In FIG. 14C, a size of the document 16 such as A4 is displayed first on the display 98 by the document size sensor means 52 which is built in the ADF 38 or by manipulation of the document key $SW_{30}$ provided on the control panel 88. Concerning the size of the paper 30, a size sensed by the paper size sensor means 64 such as A3 is displayed. Also displayed are the trimming data and magnification entered. Further, a particular configuration of the non-erase area 102 as set up on the basis of such data is graphically displayed by the display 98 in such a manner as to allow one to recognize its relationship with the document size, paper size, trimming size, etc. (as well as a picture size after a change of magnification, although not shown in the drawing; the display conditions as shown in FIGS. 15A and 15B). In this condition, the operator is capable of imagining conditions of a copy to be produced and, if they are not desired ones, changing the magnification, paper size and others before a copying cycle is started.

In summary, it will be seen that in accordance with the present invention a non-erase area is set up in consideration of a paper size, document size, trimming size and magnification and, then, latent images outside of the non-erase area are erased by eraser means. This eliminates wasteful tone consumption and excessive loads on a cleaning unit otherwise caused by development of needless images, while preventing smears on a conveyor belt and others from being reproduced on a paper. This enhances the quality of reproduction. In addition, because the configuration of such a non-erase area is displayed by display means, an operator is allowed to imagine conditions of a copy beforehand and decide whether they are expected ones or not and, if not, change the magnification, paper size and others to obtain desirable copies.

Various modifications will become possible for those skilled in the art after receiving the teachings of the present disclosure without departing from the scope thereof.

What is claimed is:

1. In a copier which forms a latent image on a photoconductive element and which is responsive to various sized papers wherein the direction in which the papers are fed is assumed to be a direction x and a direction perpendicular thereto a direction y, said copier comprising:

paper size detector means for sensing a paper size (Px, Py) representative of the size of the papers;

document size detector means for sensing a document size (Ox, Oy) representative of a size of the documents being copied;

trimming area detector means for sensing a trimming area size (Tx, Ty) representative of an area size after trimming;

magnification detector means for sensing a magnification R selected; and eraser means for erasing needless electrostatic latent images formed on the photoconductive element;

a means for determining the overlapping length of said Px, Ox X R and Tx X R selected in accordance with a length of a non-erase area in the direction x, an overlapping length of said Py, Oy X R and Ty X R selected in accordance with a length of the non-erase area in the direction y, whereby said erase means erases the latent images outside of the non-erase area.

2. A copier as claimed in claim 1, further comprising:

a display means for displaying a configuration of the non-erase area.

* * * * *